US010562545B2

(12) United States Patent
Gillis

(10) Patent No.: US 10,562,545 B2
(45) Date of Patent: Feb. 18, 2020

(54) COVERED HOPPER CAR WITH STIFFENED BULKHEADS

(71) Applicant: Gunderson LLC, Portland, OR (US)

(72) Inventor: Michael Gillis, Portland, OR (US)

(73) Assignee: Gunderson LLC, Portland, OR (US)

( * ) Notice: Subject to any disclaimer, the term of this patent is extended or adjusted under 35 U.S.C. 154(b) by 581 days.

(21) Appl. No.: 15/345,223

(22) Filed: Nov. 7, 2016

(65) Prior Publication Data

US 2018/0127004 A1 May 10, 2018

(51) Int. Cl.
*B61D 7/02* (2006.01)
*B61D 17/04* (2006.01)

(52) U.S. Cl.
CPC ..... *B61D 17/048* (2013.01); *B61D 7/02* (2013.01)

(58) Field of Classification Search
CPC ..... B65D 7/02; B61D 17/048; B61D 17/08; B61D 7/02; B60P 3/205
USPC ..... 105/248; 220/563
See application file for complete search history.

(56) References Cited

U.S. PATENT DOCUMENTS 1,332,857 A * 3/1920 Russell ..... B61D 17/06 105/410
1,547,831 A * 7/1925 Small ..... B61D 17/08 105/410
1,681,819 A * 8/1928 Small ..... B61D 17/12 52/45
2,079,862 A 5/1937 Kiesel, Jr.
2,092,457 A 9/1937 Kiesel, Jr.
2,143,788 A * 1/1939 Miller ..... B61D 17/048 296/24.4
2,200,240 A * 5/1940 Gilpin ..... B61D 17/08 105/409
3,040,679 A 6/1962 Warntz
3,399,499 A 9/1968 Stetz et al.
3,490,387 A 1/1970 Halcomb
3,495,548 A 2/1970 Rollins
3,509,827 A 5/1970 Sutter
3,515,051 A 6/1970 Pulcrano
3,538,657 A 11/1970 Mowatt-Larsen
3,557,713 A 1/1971 Spence et al.
3,570,592 A 3/1971 Rollins
3,577,932 A 5/1971 Pulcrano et al.
3,583,330 A 6/1971 Freudman
3,583,331 A 6/1971 Mowatt-Larsen
3,583,564 A 6/1971 Rollins
(Continued)

FOREIGN PATENT DOCUMENTS

GB 204490 A * 10/1923 ..... E04D 3/32

*Primary Examiner* — Scott A Browne
(74) *Attorney, Agent, or Firm* — Chernoff, Vilhauer, McClung & Stenzel, LLP

(57) ABSTRACT

A covered hopper car including a plurality of hoppers adjacent one another along the length of the car, with a generally vertical stiffened bulkhead of sheet material between adjacent ones of the hoppers. The bulkhead may include a plurality of stiffeners of which each stiffener is a transversely oriented curved portion of the sheet material of the bulkhead itself, displaced from the vertical main plane of the bulkhead. A radius of curvature is great enough and all surfaces of the stiffener are steep enough that granular material will slide downward from the stiffener and all surfaces of the stiffener can easily be washed by a spray directed from a hatch opening in the roof of the covered hopper car.

17 Claims, 6 Drawing Sheets

(56) References Cited

U.S. PATENT DOCUMENTS 3,635,182 A * 1/1972 Paffett ..... B63B 39/005 114/267
3,675,591 A 7/1972 Nagy et al.
3,789,773 A * 2/1974 McNally ..... B61D 7/02 105/248
3,918,370 A 11/1975 Campbell et al.
3,921,537 A 11/1975 Fleshman et al.
4,003,319 A 1/1977 Campbell et al.
4,168,665 A 9/1979 Needham et al.
4,232,989 A 11/1980 Miller
4,262,602 A 4/1981 Patil et al.
4,292,898 A 10/1981 Gordon et al.
4,334,481 A 6/1982 Przybylinski et al.
4,352,331 A 10/1982 Anderson et al.
4,366,757 A 1/1983 Funk
4,377,058 A * 3/1983 Hallam ..... B61D 39/00 105/248
4,484,528 A 11/1984 Anderson et al.
4,493,266 A 1/1985 Augustine, Jr.
4,497,258 A 2/1985 Ruhmann et al.
4,498,400 A 2/1985 Vorwerk et al.
4,598,646 A 7/1986 Dugge et al.
4,608,931 A 9/1986 Ruhmann et al.
4,630,548 A 12/1986 Wiger et al.
4,696,088 A 9/1987 Miller
4,741,274 A 5/1988 Ferris et al.
4,875,417 A 10/1989 Coulborn et al.
4,884,511 A 12/1989 Hallam et al.
4,893,568 A 1/1990 Adams
4,898,101 A 2/1990 Harter
4,922,833 A 5/1990 Coulborn et al.
4,930,427 A 6/1990 Ritter et al.
4,941,411 A 7/1990 Wong
4,966,081 A 10/1990 Dominguez et al.
5,144,895 A 9/1992 Murray
5,159,882 A 11/1992 Krug et al.
5,259,322 A * 11/1993 Dominguez ..... B61D 3/14 105/247
5,263,421 A 11/1993 Lichty et al.
5,367,958 A 11/1994 Weiss et al.
5,390,607 A 2/1995 Lydic
5,762,003 A 6/1998 Downes et al.
5,860,366 A 1/1999 Lydic
5,934,200 A 8/1999 Lydic
6,019,049 A 2/2000 Gaydos et al.
6,044,771 A 4/2000 Nguyen
6,067,912 A 5/2000 Miller
6,119,345 A 9/2000 Lydic et al.
6,220,502 B1 4/2001 Gallinger et al.
6,237,505 B1 5/2001 Sande et al.
6,244,191 B1 6/2001 Lydic
6,276,058 B1 8/2001 Gallinger et al.
6,279,217 B1 * 8/2001 Gallinger ..... B23K 37/0229 29/281.1
6,279,487 B1 8/2001 Gaydos et al.
6,334,397 B1 * 1/2002 Valgora ..... B61D 7/02 105/248
6,502,518 B1 1/2003 Miller
6,604,469 B1 8/2003 Galvan et al.
8,053,034 B1 * 11/2011 Dickinson ..... C23C 2/003 427/430.1
D665,704 S * 8/2012 Lobson ..... D12/106
2002/0157563 A1 10/2002 Richmond et al.
2004/0244638 A1 12/2004 Taylor
2005/0056185 A1 3/2005 Herzog et al.
2005/0056186 A1 3/2005 Creighton et al.
2008/0035014 A1 * 2/2008 Gillis ..... B61D 7/02 105/248
2009/0241799 A1 10/2009 Saxton et al.
2018/0334178 A1 * 11/2018 Gillis ..... B61D 17/08

* cited by examiner

COVERED HOPPER CAR WITH STIFFENED BULKHEADS

BACKGROUND OF THE INVENTION

The present invention relates to railroad freight cars, and in particular to stiffened bulkheads between hoppers of a covered hopper car.

Covered hopper railroad cars for carrying bulk cargo such as grain, sand, fertilizer, woodchips, and the like may have two or more hoppers located adjacent one another along the length of a hopper car. Such a hopper car typically has a slope sheet at each end of the car and additional slope sheets leading to the outlets at the bottoms of the several hoppers. Vertical transverse bulkheads usually of sheet metal, separate adjacent ones of the hoppers and extend from the top of the car down to the upper end of a slope sheet of each one of a pair of the hoppers separated by the bulkheads.

A hatch is typically provided in the roof of the car at the top of each hopper so that cargo can be loaded into the hopper, and to facilitate washing the interior of a hopper after emptying the car and before loading the car with a different type of cargo. Some types of cargo, such as some types of plastic resins, may be granular, in pellet form, or even of a finely divided flour-like particulate composition, and may not readily flow out from a hopper when unloading a car.

In order to assure that a hopper is readily emptied and that the entire surface of a bulkhead between hoppers can be washed clean by spraying from the topside hatch, some prior bulkheads have been a single planar piece. Such a large flat expanse of sheet metal, however, is subjected to various forces during loading, unloading, and travel of the hopper car, with the result that cracking too often occurs around the perimeter of such a planar bulkhead. A low natural resonant frequency of such a planar bulkhead can result in failure of the bulkhead, caused by vibration when a car travels empty.

In order to stiffen a bulkhead without adding excessive weight to the railcar, it has been known to bend the sheet material of a bulkhead along parallel horizontal lines to form a stiffener that may resemble a channel beam extending transversely along the bulkhead. Typically two such stiffeners have been incorporated in a bulkhead, each having sloping top and bottom portions joined by a vertical portion that is offset, in a longitudinal direction with respect to the car body, from a vertical main plane of the bulkhead. Each stiffener thus may have a trapezoidal profile and typically extends the full width of the car body. Such stiffeners reduce the ability of the bulkhead to flex and thus tend to reduce cracking at the margins of the bulkhead, but the stiffeners add to the weight of a car and may have other problems.

Because of the shape and desired locations of such prior art stiffeners, some granular and particulate cargo materials, especially non-slippery cargo materials having a low density, tend to accumulate and remain atop a stiffener of the type just described, so that the hopper does not empty itself completely. Additionally, it has been impossible to wash the underside of a lower stiffener of such a design satisfactorily with a spray directed from a topside hatch of a hopper including such a stiffened bulkhead.

What is desired, then, is a covered hopper car including adequately stiffened, yet not excessively heavy, bulkheads between adjacent hoppers. It is also desired for such stiffeners to promote flow of all of a granular or particulate cargo from a hopper. It is also desired for the stiffened bulkhead in such a covered hopper car to have all of its surfaces available to be washed effectively by a spray directed from a topside hatch opening of a hopper including such a bulkhead.

SUMMARY OF THE INVENTION

The present invention overcomes the aforementioned shortcomings of prior art railroad freight cars by providing an improved covered hopper car in which there are stiffened bulkheads between adjacent hoppers as described below and as defined in the claims which form a part of this disclosure.

A railroad car which is one embodiment of the invention includes a car body incorporating several hoppers located adjacent one another along the length of the car body. In such a car adjacent hoppers are separated from one another by a transversely extending vertical bulkhead that extends from an upper boundary of each hopper downward to the upper margins of the slope sheets of a pair of adjacent hoppers. The bulkhead may be of sheet metal and may incorporate stiffeners in the form of arcuately curved projecting portions that are connected with upwardly and downwardly adjacent vertical portions of the bulkhead by oppositely-curved fairing portions.

In a stiffened bulkhead which is one embodiment of the present invention a stiffener may be a formed portion of the sheet metal material of which the bulkhead is constructed and may extend transversely across the entire width of a hopper. Such a stiffener may include a convex curved protrusion in the form of the shell of a portion of a circular cylinder with a horizontal axis that extends transversely parallel with the bulkhead, and having a cylinder radius of, for example, about 10 inches. The curved configuration of such a stiffener requires less additional sheet material and thus adds less weight to a flat bulkhead of similar material than a stiffener of the trapezoidal configuration mentioned above, yet adds the required stiffness to the bulkhead.

In a stiffened bulkhead which is one embodiment of the present invention a main portion of such a stiffener may have the form of such a horizontal convexly curved protrusion from the vertical main plane of the bulkhead, with its top and bottom faired into the upwardly and downwardly adjacent vertical and planar portions of the bulkhead through oppositely-curved fairing portions, each of whose radius of curvature may be similar to that of the stiffener, such as being about 10 inches.

In such a stiffened bulkhead every surface of a stiffener may be arcuately curved and every tangent to each such surface, as seen in a vertical plane oriented normal to a main plane of the stiffened bulkhead, is sloped downwardly with respect to the horizontal. A plane that is tangent to the stiffener along a line of inflection where the main stiffener portion meets a fairing portion thus may be oriented at a predetermined angle in the range of 49° to 70° from a horizontal plane. This makes all surfaces of the bulkhead, including the stiffener, steep enough to ensure that granular or particulate cargo should slide along the stiffened bulkhead to empty a hopper bounded by the stiffened bulkhead, and also results in every surface of the stiffened bulkhead being exposed to a spray directed from a hatch opening at the top of the car.

In a stiffened bulkhead which is an embodiment of one aspect of the present invention there may be two or more stiffeners arranged one above another and spaced apart from one another, but interconnected by generally vertical, planar portions of the bulkhead, and the bulkhead may include generally coplanar and vertical top and bottom planar portions.

The foregoing and other objectives and features of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1:
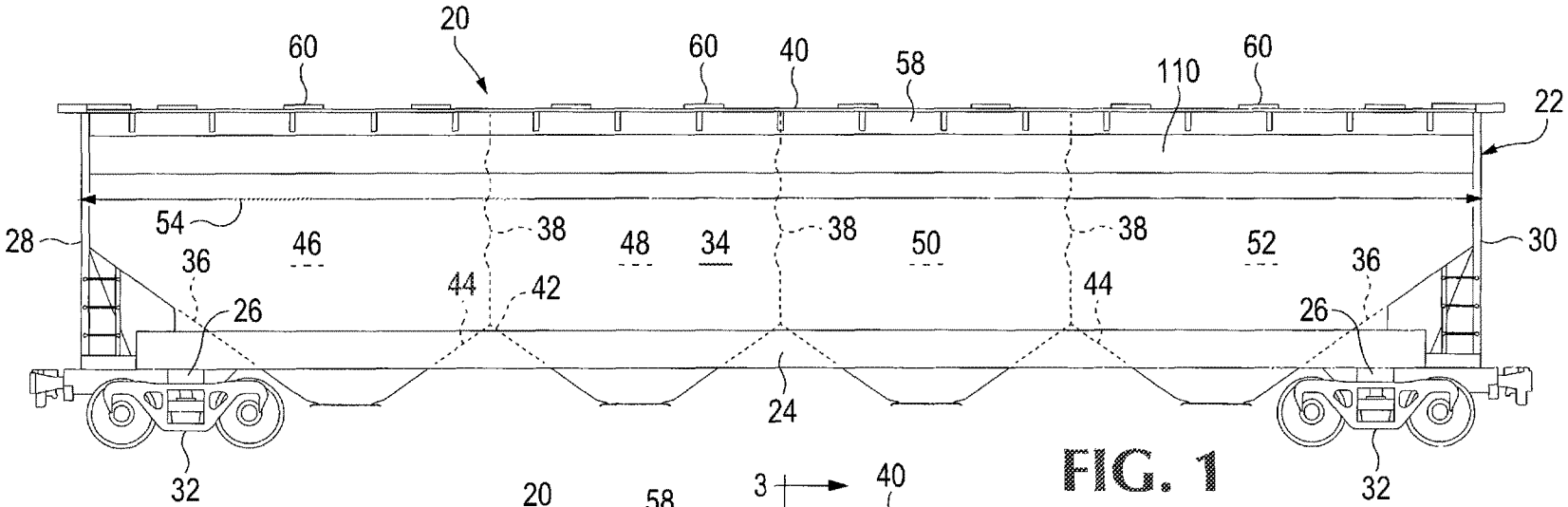
FIG. 1 is a side elevational view of a covered hopper railroad freight car incorporating stiffened bulkheads that are an embodiment of an aspect of the present invention.
Figure 2:
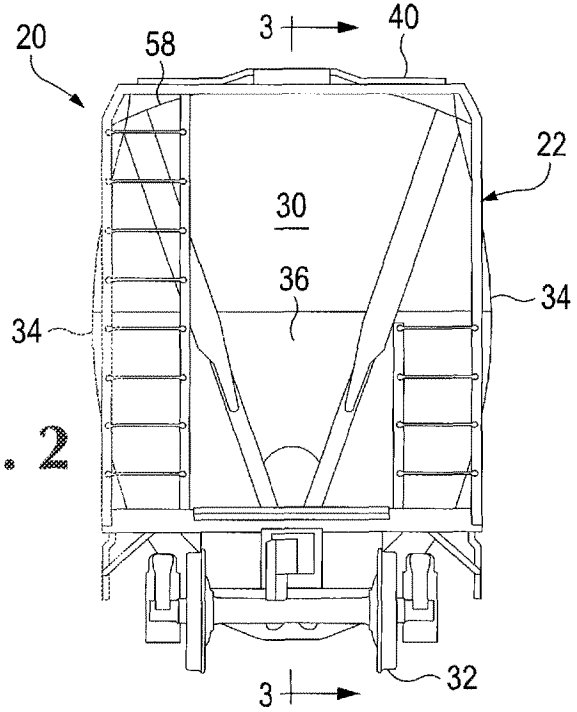
FIG. 2 is an end elevational view of the car shown in FIG. 1.

Referring now to the drawings which form a part of the disclosure herein, a covered hopper car 20 shown in FIGS. 1 and 2 includes a car body 22 having a pair of tubular side sills 24 supported on a body bolster 26 at each one of a pair of ends 28 and 30 of the car body 22. A pair of wheeled trucks 32 support the car body 22 through the body bolsters 26. The car body 22 may include generally vertically and longitudinally extending opposite side walls 34 of sheet metal construction and may have a slope sheet 36 at each end 28 and 30 of the car body, joined to the side walls 34 and supported suitably above the side sills 24 and the respective body bolster 26 in a generally conventional manner.

Figure 4:
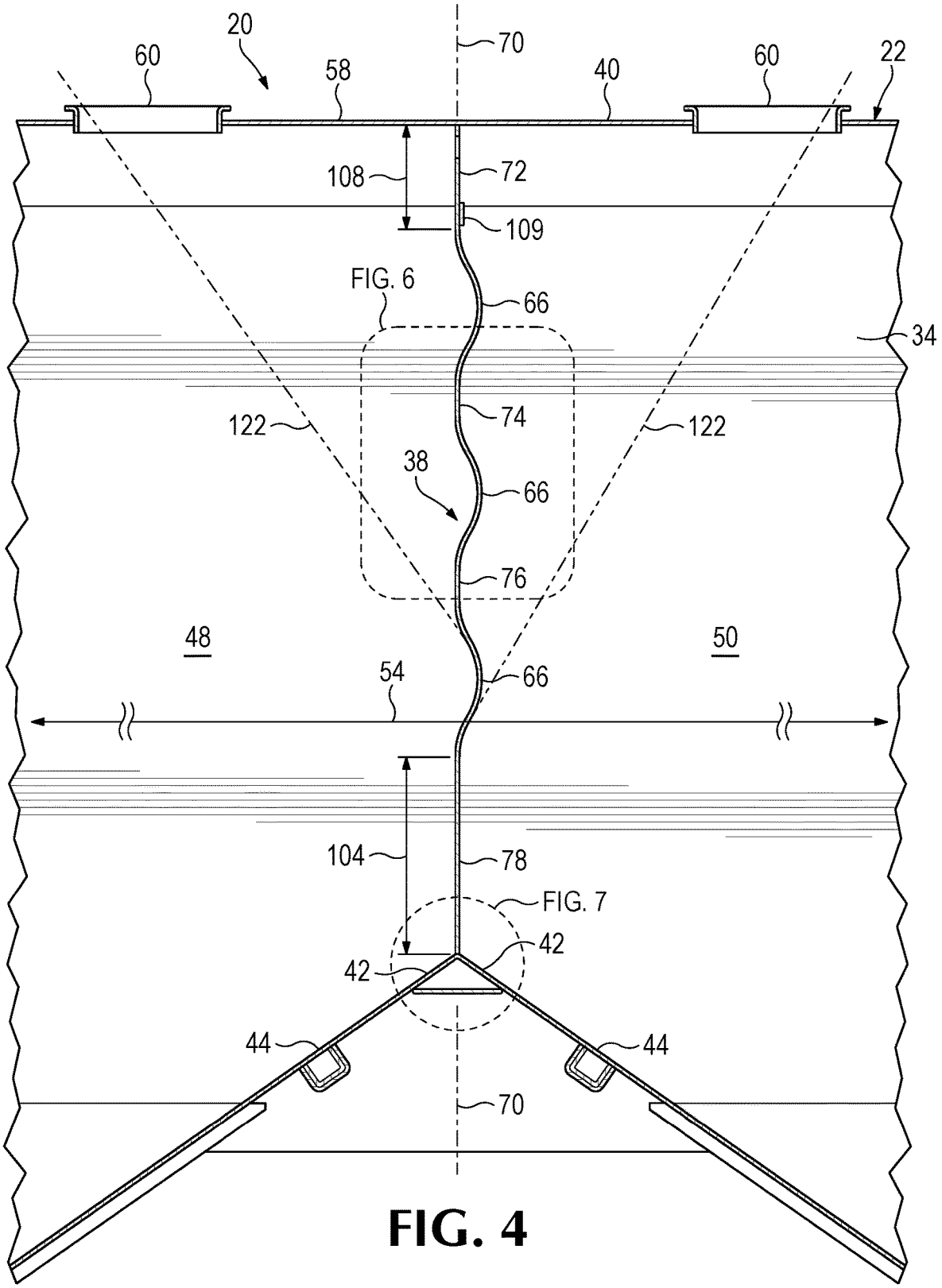
FIG. 4 is a sectional view taken along line 3-3 in FIG. 2, showing the profile of a stiffened bulkhead between hoppers of the hopper car shown in FIGS. 1 and 2.
Figure 5:
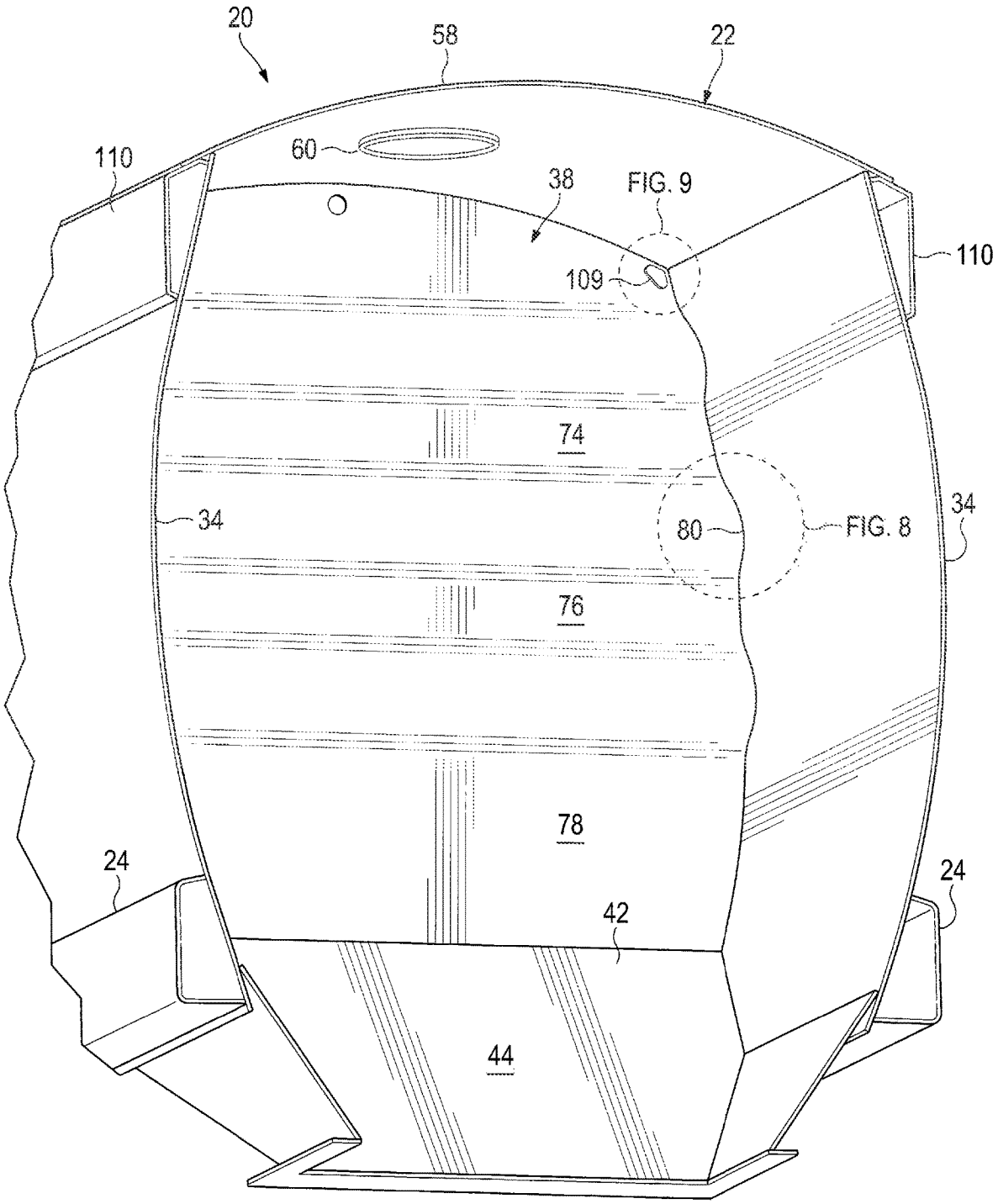
FIG. 5 is an isometric view looking longitudinally along and upward toward a portion of the hopper car shown as cut away along the line 5-5 in FIG. 1, so as to show one of the bulkheads incorporating the stiffeners disclosed in the present application.
Figure 6:
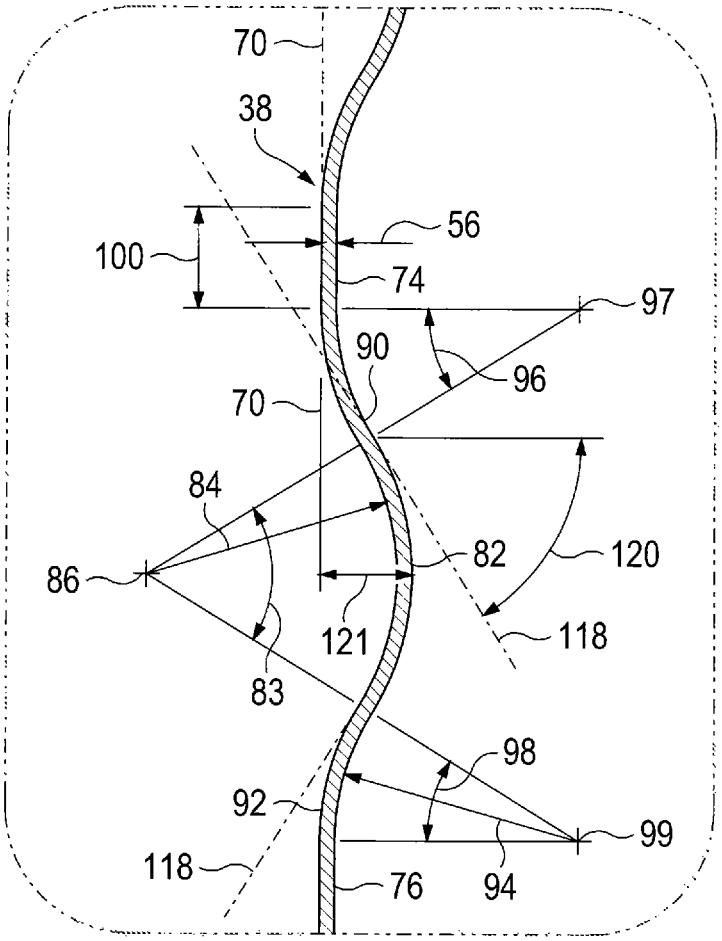
FIG. 6 is a detail view showing a portion of FIG. 4 at an enlarged scale.
Figure 7:
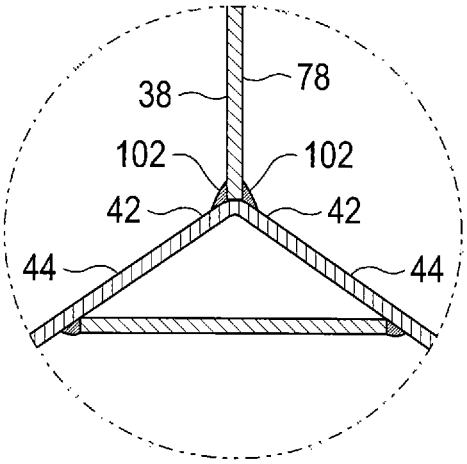
FIG. 7 is a detail view at an enlarged scale, showing one manner of attaching the bulkhead shown in FIG. 4 to the slope sheets defining bottom portions of adjacent ones of the hoppers of the hopper car shown in FIG. 1.

Three generally vertical bulkheads 38 extend downward from the top 40 of the car body 22 to the upper ends 42 of respective slope sheets 44 of four separate hoppers 46, 48, 50, and 52 arranged adjacent one another along a length 54 of the car body 22. As shown in FIGS. 4, 5, and 6, the bulkheads 38 may be of sheet metal, such as type ASTM 1011 sheet steel with a thickness 56 of 0.179 inch, for example. The bulkheads 38 may be welded to the roof structure 58 of the car body, to the side walls 34 of the car body 22, and to the top ends 42 of the slope sheets 44 of the hoppers, as shown at an enlarged scale in FIGS. 7, 8, and 9. Covered hatch openings 60 are provided along the roof 58 of the car body 22, usually evenly spaced apart along the length 54 of the car body 22.

Figure 3:
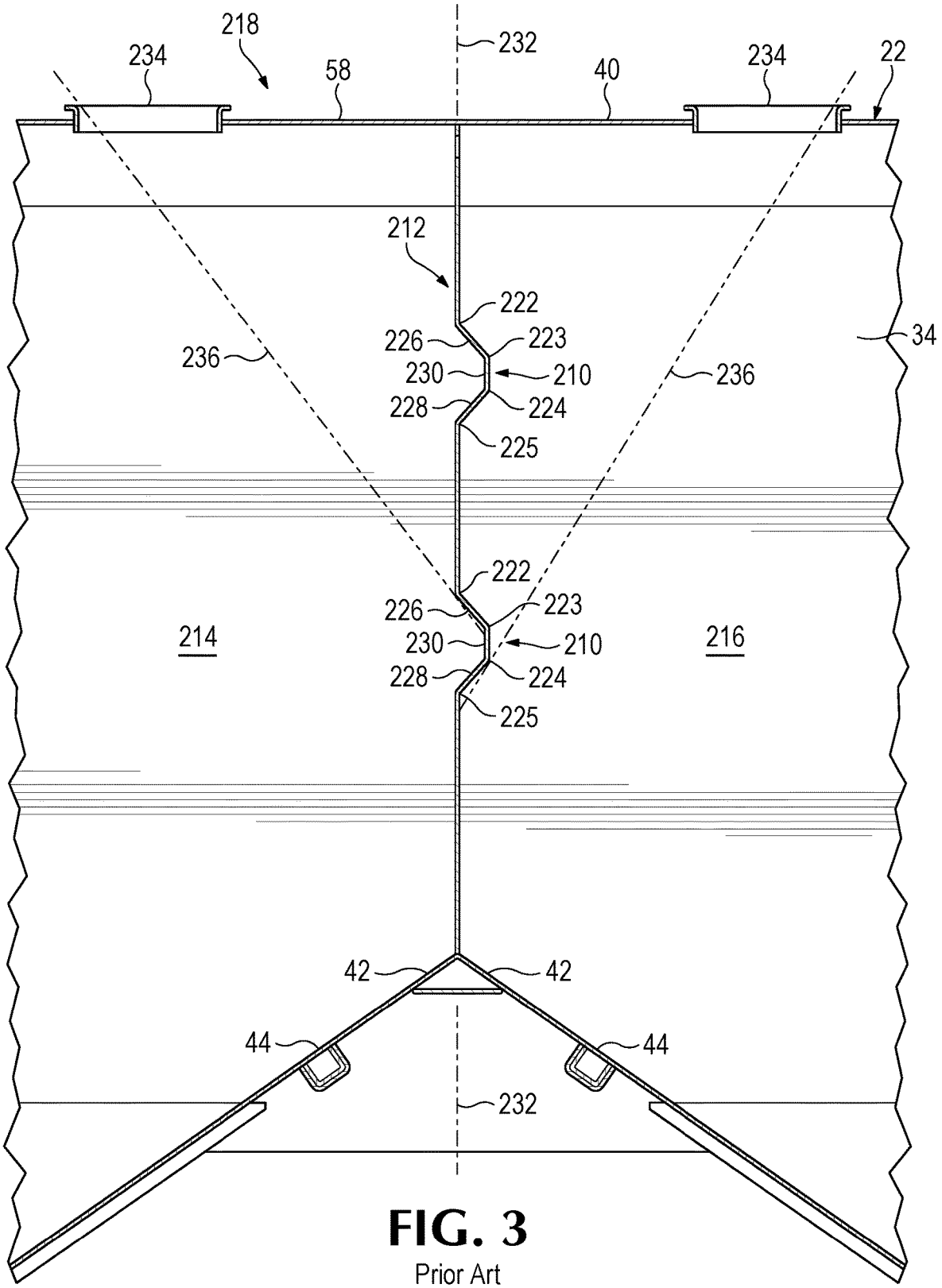
FIG. 3 Prior Art
FIG. 3 is a sectional view, taken in the direction of line 3-3 in FIG. 2, showing a profile of a prior art stiffened bulkhead of a sort located between hoppers of a prior art hopper car generally similar to the car shown in FIGS. 1 and 2.

As mentioned above and as shown in sectional view in FIG. 3, it has been known in the past to provide stiffeners 210 in a bulkhead 212 of sheet metal between hoppers 214, 216 of a prior art covered hopper car 218 by bending the metal sheet of a bulkhead 212 along transversely-extending horizontal bend lines 222, 223, 224 and 225. Each stiffener 210 is thus a portion of the bulkhead 212 that can act as a channel beam having sloping upper and lower flange-like portions 226 and 228, joined by a vertical web-like portion 230 offset from a main plane 232 of the bulkhead 212. Such stiffeners 210 thus may have the shape of an open-based trapezoid, as seen in profile in FIG. 3. As mentioned previously, however, with such prior art stiffeners 210, a lower surface of either flange-like portion 226 or 228 of a lower stiffener 210 of a bulkhead 212 is likely not to be exposed to be washed effectively by a spray directed from a hatch opening 234 in the top of the car, as indicated by the lines 236 in FIG. 3, extending from the hatch openings 234 toward the bulkhead 212.

As shown in FIGS. 4-9, the car body 22 includes stiffened bulkheads 38 extending transversely within the car body 22 from one to the other of the side walls 34 and separating the hoppers 46, 48, 50, and 52 from one another. Each of the stiffened bulkheads 38 between adjacent ones of the hoppers in the car body includes three stiffeners 66. Depending on the dimensions of the specific stiffener it may be desirable to include four or more stiffeners, as will become apparent. The stiffeners 66 extend transversely with respect to the car body 22 and may extend generally horizontally along each bulkhead 38, from side to side of the car body 22. The stiffeners 66 are spaced apart vertically from one another in the respective bulkhead 38 and are also spaced apart vertically from the top and bottom of the car body 22.

Each stiffener 66 has an arcuately curved shape, so that it protrudes convexly away from a main plane 70 of the bulkhead 38 defined by vertical coplanar portions 72, 74, 76, and 78, as may be seen in section view in FIG. 4. Each stiffener 66 is faired into the vertical planar portions of the bulkhead 38 located upwardly adjacent and downwardly adjacent to the stiffener 66.

Figure 8:
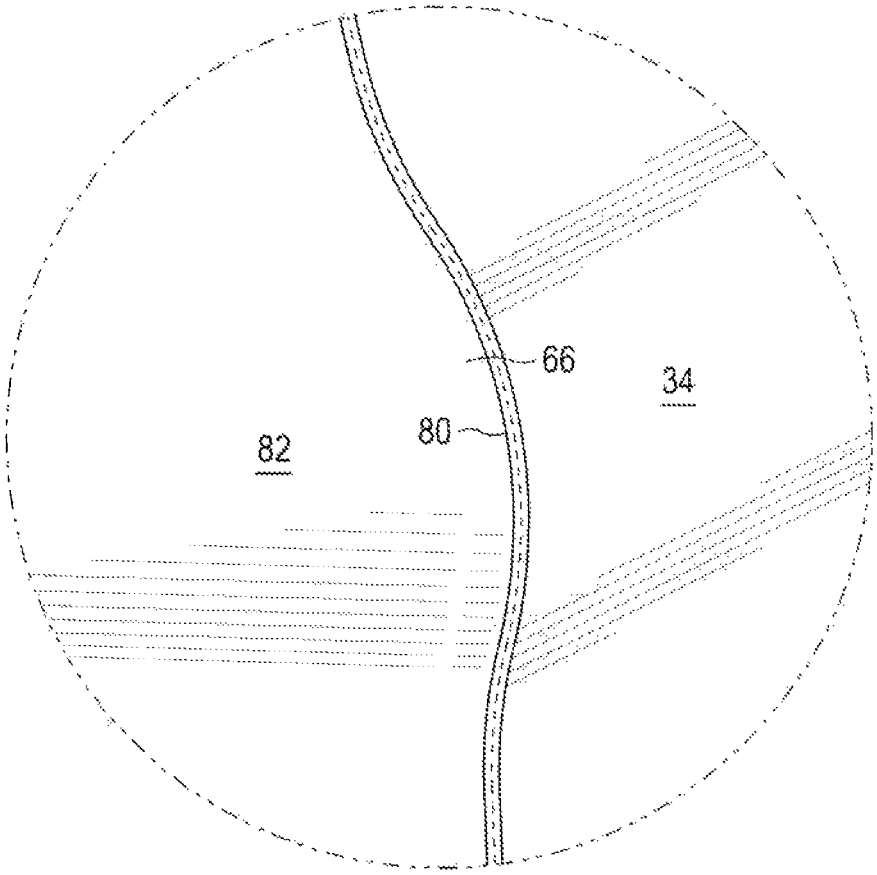
FIG. 8 is a detail view showing the manner of attachment of the stiffened bulkhead shown in FIGS. 4-7 to the side members of the hopper car shown in FIGS. 1, 2, and 3-5.
Figure 9:
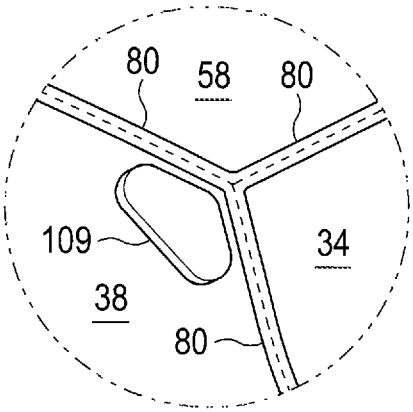
FIG. 9 is a detail view showing the manner of attachment of an upper corner of the stiffened bulkhead shown in FIGS. 4-7 to the side members and roof structure of the hopper car shown in FIGS. 1,2, and 3-5.

Each stiffened bulkhead 38 is welded to the adjacent side wall 34 as shown in FIG. 8, and is also welded to the underside of the roof 58 as shown in FIG. 9, with fillet welds 80.

In one embodiment, as shown best in FIG. 6, each stiffener 66 may include a main stiffener portion 82 in the form of a sector of a right circular cylindrical shell. The cylindrical shape of the main stiffener portion 82 thus has a radius 84 that may be in the range of about 5.5 inches to about 12 inches and may preferably be about 10 inches from a respective cylinder axis 86. The cylinder axis 86 of curvature of the main stiffener portion 82 thus extends horizontally, parallel with the main plane 70 of the bulkhead 38. A upper fairing portion 90 and a lower fairing portion 92 included in each stiffener 66 may similarly be in the form of partial cylinders. Each may have a radius 94 similar to the radius 84, in which case each fairing portion extends through a respective angle 96, 98, about its respective cylinder axis 97 or 99, having a size equal to about half of the angle 83 occupied by the main stiffener portion 82. The fairing portions 90 and 92 thus fair the stiffener 66 smoothly into an adjacent vertical portion 72, 74, 76, or 78 of the bulkhead, as may be seen in FIG. 4 and as shown in greater detail in FIG. 6.

The stiffener or stiffeners 66 may be made by pressing a flat piece of sheet metal into the desired form.

In the car body 22, as shown best in FIGS. 4 and 5, each bulkhead 38 may include three such stiffeners 66 which may be spaced apart from one another and interconnected by coplanar vertical portions 74 and 76 of the bulkhead 38. Depending on the overall height of the hoppers 46, 48, 50, and 52, each of the coplanar vertical portions 74, if present between the stiffeners 66, may have a height 100 in the range of 2 inches to 12 inches. A planar bottom portion 78 of the bulkhead 38, beneath the lowest of such stiffeners 66, extends down to the upper ends 42 of the slope sheets 44 and may have a height 104 of 27 inches. The bottom portion 78 may be attached to the upper ends 42 of the slope sheets 40 by a fillet weld 102 on each side, to avoid presenting a shelf that might catch cargo being emptied from the hoppers.

A generally planar upper end portion 72 of the bulkhead 38 may extend upward a distance 108, which may be about 14 inches, above the uppermost one of the stiffeners 66, and beyond the top of each side wall 34 of the car body 22 to the interior of the roof structure 58 between adjacent ones of the hoppers, to ensure that each of the hoppers 46, 48, 50, and 52 is completely separated from an adjacent one of the hoppers.

As shown in FIG. 9, there may be doubler plates 109 in the upper corners of the bulkhead 38, on at least one face of the bulkhead 38, in the vicinity of where the roof structure 58 is joined with a top chord 110 of car body 22, to avoid stress concentrations in that area of the car body 22.

As a result of the shape of the stiffener 66, determined by the selected combination of the radius of curvature 84 or 94 and the angles 83, 96, and 98 over which portions 82, 90, and 92 of the stiffeners 66 extend, a plane 118 that is tangent to any of the upwardly-facing sloped surfaces of the stiffener 66, as seen in a vertical plane normal to the main plane 70 of the stiffened bulkhead 38, is oriented at an angle 120 in the range of 49° to 70° with respect to the horizontal. The plane 118 that is tangent to an upper surface of the main stiffener portion 82, at the line of inflection where it joins the upper fairing portion 90, is at an angle 120 of, for example, about 58° to the horizontal, corresponding to an angle of 32° to the vertical main plane 70 of the bulkhead 38, as shown in FIG. 6. The angle 120 is preferably in the range of 49° to 70° in size, corresponding to an angle in the range of 41° to 20° relative to the vertical main plane 70, and may be an angle of 55°, corresponding to an angle of 35° to the vertical main plane 70. The angle 120 would thus be smallest at the line of inflection, or junction, between the main stiffener portion 82 and an adjacent fairing portion 90 or 92. This steep downward slope of the upwardly facing sloped surfaces on each side of the stiffener 66 minimizes the likelihood that any granular or particulate cargo within one of the hoppers 46, 48, 50, or 52 would fail to slide downward along the bulkhead 38 to the adjacent slope sheet 44 at the bottom of the respective hopper.

As a result of this configuration of the stiffeners 66, a surface of the main stiffener portion 82 is spaced apart from the vertical main plane 70 of the bulkhead 38, in a direction along the length 54 of the car body 22, by an offset distance 121 whose maximum is designed to be in the range of 2 inches to 6 inches, and which is preferably 4 inches or less and most preferably about 3 inches or less. The maximum offset distance 121 thus is preferably less than that in the prior art stiffeners 210 resembling channel beams, as mentioned above, yet provides ample stiffening of the bulkhead 38 with a minimum of additional weight beyond the weight of a completely planar vertical bulkhead. It will be understood that the radii of curvature 84 and 94 and the angles 83, 96, and 98 will determine the maximum offset distance 121 but that they will be selected to result in the size of the angle 120 being in the required range.

As may be seen in FIG. 4 the shape of each stiffener 66 also results in all of the surfaces of the bulkhead 38 being exposed to be washed by a spray in a direct line 122 from a hatch opening 60 in the roof 58 of the car 20 so that all of the surfaces of the bulkhead 38 can be spray washed reliably.

It will also be understood that the stiffeners 66 may have a shape (not shown) somewhat different from a portion of a right circular cylinder, and that rather than being level and horizontal along a transverse direction along the bulkhead the axes of curvature 130 of the stiffeners might slope from one side of the car 20 to the other. Also, the individual stiffeners 66 might be arranged in a zig-zag relationship rather than being parallel with each other. Furthermore, it will be understood that the stiffeners 66 might be shaped as truncated conical sectors rather than partial cylinders. Each of these possible configurations of the stiffeners could be manufactured with dimensions providing the advantageous characteristics of desired stiffening for the bulkhead: requiring less material than the prior art trapezoidal stiffeners 210, having surfaces steep enough not to retain quantities of a granular cargo, and not including surfaces inaccessible to being spray washed.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A stiffened transverse bulkhead separating a pair of longitudinally adjacent covered hoppers in a car body of a railroad freight car having a width, a top, and a bottom, the bulkhead comprising:

(a) a bulkhead member of sheet material extending generally in an upright, transverse, main bulkhead plane within a covered hopper car, the bulkhead member having a height and a width; and (b) a bulkhead stiffener included in the bulkhead member and extending along the bulkhead member and the width of the car, the bulkhead stiffener including (i) a convexly-curved main stiffener portion having an axis of curvature oriented transversely with resect to the car;

(ii) an upper fairing portion, curved oppositely with respect to the main stiffener portion and interconnected with the main stiffener portion and located between the main stiffener portion and an upwardly adjacent portion of the bulkhead member and interconnecting the main stiffener portion with an upwardly adjacent portion of the bulkhead member extending in the main bulkhead plane; and (iii) a lower fairing portion, curved oppositely with respect to the main stiffener portion and interconnected with the main stiffener portion and located between the main stiffener portion and a downwardly adjacent portion of the bulkhead member and interconnecting the main stiffener portion with a downwardly adjacent portion of the bulkhead member extending in the main bulkhead plane; wherein the main stiffener portion, the upper fairing portion, and the lower fairing portion of the bulkhead stiffener all include respective inclined arcuate surfaces, wherein each of said inclined arcuate surfaces is oriented so that a plane that is tangent to said one of said inclined arcuate surfaces at a location where the main stiffener portion is interconnected with either of the upper and lower fairing portions is oriented at an angle in the range of 20 degrees to 41 degrees with respect to the upright transverse main bulkhead plane.

2. The stiffened bulkhead of claim 1 wherein the bulkhead stiffener includes a portion of the sheet material of the bulkhead member that is displaced away from the main plane of the bulkhead and has a radius of curvature within the range of 5.5 inches to 12 inches.

3. The stiffened bulkhead of claim 1 wherein each of the upper and lower fairing portions interconnects the main stiffener portion with the respective adjacent portion of the bulkhead member in a smoothly faired manner.

4. The stiffened bulkhead of claim 1 wherein every said plane that is tangent to said one of said inclined arcuate surfaces is oriented at an angle no greater than 35° with respect to the upright transverse main bulkhead plane.

5. The stiffened bulkhead of claim 1 wherein the bulkhead member includes a planar vertical top portion extending in the upright transverse main bulkhead plane above the bulkhead stiffener and a planar vertical bottom portion extending in the upright transverse main bulkhead plane below the bulkhead stiffener.

6. The stiffened bulkhead of claim 1 including a plurality of the bulkhead stiffeners spaced apart vertically from one another and spaced apart vertically from the top and the bottom of the car body.

7. The stiffened bulkhead of claim 6 including a planar vertical portion extending in the upright transverse main bulkhead plane and located between and interconnecting a pair of the bulkhead stiffeners.

8. The stiffened bulkhead of claim 6 wherein the main stiffener portion of each of the plurality of bulkhead stiffeners has a horizontal axis of curvature and a radius within the range of 5.5 inches to 12 inches and is shaped as a cylindrical sector.

9. The stiffened bulkhead of claim 1 wherein no surface of the main stiffener portion is spaced apart from the main bulkhead plane by an offset distance greater than 6 inches.

10. The stiffened bulkhead of claim 1 wherein no surface of the main stiffener portion is spaced apart from the main bulkhead plane by an offset distance greater than 4 inches.

11. The stiffened bulkhead of claim 1 wherein no surface of the main stiffener portion is spaced apart from the main bulkhead plane by an offset distance greater than 3 inches.

12. The stiffened bulkhead of claim 1 wherein no surface of the main stiffener portion is spaced apart from the main bulkhead plane by an offset distance greater than 2 inches.

13. A railroad freight car for carrying bulk cargo, comprising:

(a) a car body having a length and a pair of opposite side walls and including a pair of hoppers between the side walls and arranged longitudinally adjacent each other along the length of the car body;

(b) a stiffened transverse bulkhead separating the ones of the pair of adjacent hoppers from each other, the bulkhead including a sheet member defining a main plane of the bulkhead extending generally vertically and transversely with respect to the car body;

(c) a bulkhead stiffener incorporated in the sheet member and extending along the sheet member transversely with respect to the car body, the bulkhead stiffener including a convexly curved main stiffener portion protruding from the main plane of the bulkhead and having an axis of curvature oriented transversely with respect to the car;

(d) a vertically-oriented planar portion included in the sheet member adjacent to the stiffener; and (e) a fairing portion, curved oppositely with respect to the main stiffener portion, included in the stiffener between the main stiffener portion and the vertically-oriented planar portion of the sheet member and interconnecting the convexly curved main stiffener portion with the adjacent vertically-oriented planar portion of the sheet member; wherein the main stiffener portion and the fairing portion of the bulkhead stiffener all include respective inclined arcuate surfaces, wherein each of said inclined arcuate surfaces is oriented so that a plane that is tangent to said one of said inclined arcuate surfaces at a location where the main stiffener portion is interconnected with the fairing portion is oriented at an angle in the range of 20 degrees to 41 degrees with respect to the vertically-oriented planar portion.

14. The railroad freight car of claim 13 wherein the convexly curved main stiffener portion of the stiffener has a cylindrical shape, and has a cylinder radius in the range of 5.5 to 12 inches.

15. The railroad freight car of claim 13 wherein the convexly curved main stiffener portion of the stiffener has a cylindrical shape, and has a cylinder radius in the range of 7 to 11 inches.

16. The railroad freight car of claim 13 wherein the convexly curved main stiffener portion of the stiffener has a cylindrical shape, and has a cylinder radius of 10 inches.

17. The stiffened bulkhead of claim 1 wherein the bulkhead stiffener is spaced apart vertically from the top and the bottom of the car body.

* * * * *